US006790252B2

(12) United States Patent
Smith et al.

(10) Patent No.: US 6,790,252 B2
(45) Date of Patent: Sep. 14, 2004

(54) TUNGSTEN-CARBIDE ARTICLES MADE BY METAL INJECTION MOLDING AND METHOD

(75) Inventors: David J. Smith, Temecula, CA (US); Thomas B. Shappie, Murrieta, CA (US); Robert A. Sanford, Prospect Heights, IL (US); Richard J. Liesz, Cardiff, CA (US)

(73) Assignee: Hard Metals Partnership, Chicago, IL (US)

( * ) Notice: Subject to any disclaimer, the term of this patent is extended or adjusted under 35 U.S.C. 154(b) by 0 days.

(21) Appl. No.: 10/124,883

(22) Filed: Apr. 18, 2002

(65) Prior Publication Data

US 2002/0178862 A1 Dec. 5, 2002

Related U.S. Application Data

(60) Provisional application No. 60/284,551, filed on Apr. 18, 2001, and provisional application No. 60/350,199, filed on Jan. 18, 2002.

(51) Int. Cl.[7] ..... C22C 29/02; B22F 3/00

(52) U.S. Cl. ..... 75/240; 419/10; 419/18; 419/36

(58) Field of Search ..... 75/240, 236; 419/10, 419/18, 36, 23, 38

(56) References Cited

U.S. PATENT DOCUMENTS 3,647,401 A * 3/1972 Meadows ..... 75/229
4,113,480 A * 9/1978 Rivers ..... 419/2
4,948,426 A * 8/1990 Kato et al. ..... 419/23
5,624,766 A * 4/1997 Moriguchi et al. ..... 428/547
5,989,731 A * 11/1999 Arisawa et al. ..... 428/627
6,372,012 B1 * 4/2002 Majagi et al. ..... 75/236

FOREIGN PATENT DOCUMENTS

WO WO98/18973 * 5/1998

OTHER PUBLICATIONS

Patent Abstract, JP405033015A, Feb. 9, 1993.*

* cited by examiner

*Primary Examiner*—Ngoclan T. Mai
(74) *Attorney, Agent, or Firm*—Emrich & Dithmar LLC

(57) ABSTRACT

A process of making an article of a tungsten-carbide-cobalt alloy with or without an additive of one or more of tantalum, cobalt-nickel, nickel-tantalum, tantalum-carbide, titanium-carbide, niobium-carbide, chromium-carbide, titanium-nitride and diamond dust. The method includes forming a homogeneous mixture of polygonal-shaped powder tungsten-carbide-cobalt and a polygonal-shaped powder additive and a binder including wax and a high molecular weight polyolefin polymer and injecting the mixture under heat and pressure into a metal injection mold to form a green preform of the article. The green preform is immersed in a linear hydrocarbon or a halogenated hydrocarbon or mixtures to dissolve and remove the wax and convert the green preform into a brown preform which is sintered to remove the remainder of the binder and to densify the brown preform into an article having a density not less than 98%. Various tungsten-carbide articles are disclosed.

25 Claims, No Drawings

TUNGSTEN-CARBIDE ARTICLES MADE BY METAL INJECTION MOLDING AND METHOD

RELATED APPLICATIONS

This application, pursuant to 37 C.F.R. § 1.78(c), claims priority based on provisional application serial No. 60/284,551 filed Apr. 18, 2001 and provisional application serial No. 60/350,199 filed Jan. 18, 2002.

FIELD OF THE INVENTION

The invention relates to improved tungsten-carbide dies made by metal injection molding ("MIM").

BACKGROUND OF THE INVENTION

Tungsten-carbide dies are currently made from cylindrical blanks produced by the press and sinter method known as Powder Metallurgy or "PM." Cobalt, in various volume percentages, is blended with tungsten-carbide. A mixture of various powders are used in the process. Our process allows us to make our dies with lower percentages of cobalt (which is an advantage in itself because cobalt is expensive). This results in increased hardness and abrasion resistance when compared to dies with higher cobalt content. It is also possible to add other metals and alloys to our feedstock to give the resulting metal improved characteristics and performance.

Powder Metallurgy ("PM") uses oblong or shard-shaped powders for various reasons. To begin with, they are typically less expensive than spherical powders. More importantly, spherical powders do not work well (if at all) in PM. When the tungsten-carbide and cobalt powders are pressed into the cylindrical die, they are compressed, which gives the part its stability during the sintering process. The shard particles of various sizes, "interlock" to a certain extent. Pressing spherical powders in a PM process does not provide that interlocking.

Further, the use of spherical powders would substantially exacerbate the deformation that occurs during the sintering of PM parts. The deformation is caused primarily when the cobalt particles melt and fall through the spaces between the tungsten-carbide particles. Such deformation is already a significant problem in producing tungsten-carbide dies by PM.

In the PM process, a selected powder is pressed into a die or mold at high pressures. The pressed part is then sintered at high temperature to fuse the powders into "solid" metal. The part is not really solid, however. It has porosity, which is measured as its density (expressed as a percentage of the theoretical 100% density of wrought metal).

It is well known in the PM field that, in general, increasing the density of a sintered powdered metal item (i.e. reducing its porosity) will significantly improve its strength and durability. At high levels of porosity (i.e. low density), the metal is brittle and of low fatigue strength. Accordingly, considerable effort is expended (and significant cost incurred) in trying to increase the density of the PM blanks, which typically have a density of approximately 85% after sintering. Some of the methods include hot forging, double pressing, double sintering, hot isostatic pressing ("HIPing") and pressure assisted sintering ("PASing"). While higher densities (typically, 88% to 92%) are achievable by these methods, it is often at the cost of dimensional precision. And, there is the additional cost of those secondary processes. The blanks need further machining in order to make them into blanks ready for their inside diameter ("I.D.") profiles. Typically, the outside diameters ("O.D.") need to be brought within specifications (the ends need to be squared off and the outside surface ground down) and then the pilot hole running down the center of the blank needs to be made to a specific diameter and concentric to the O.D. The result is referred to as a "semi-finished" blank, which is ready to be made into a finished die.

Making the finished die involves cutting the I.D. profile into the blank. This is done by various means such as drilling, reaming, grinding, EDMing, etc. Tungsten carbide is very hard, so it is difficult (time-consuming and/or costly) to cut in the I.D. profile. The difficulty increases with the complexity of the I.D. profile, the tolerances that must be met and the hardness of the tungsten-carbide blank. Frequently, blanks with lower hardness and/or density are selected in order to overcome or reduce these difficulties.

The present invention provides improved tungsten-carbide dies, with improved physical properties, improved chemical properties and enhanced performance, and an improved method of manufacturing those dies. This invention relates to both the blanks and the finished dies as well as other fastener industry tools.

SUMMARY OF THE INVENTION

The present invention produces improved tungsten-carbide blanks and finished dies using MIM. MIM is an established manufacturing process. Heretofore, fine powdered metals (typically spherically-shaped) are mixed with various binders to form a feedstock. This feedstock is then heated and molded under pressure in an injection molding machine to produce a "green" part or preform. After molding, the binders are removed from the green part in a process called "debinding," producing a "brown" part or preform. The debound part is then sintered, which fuses the powdered metal particles into a densified matrix. While there is porosity in an MIM part, substantially higher densities are achievable by MIM than by PM. However, we have found that significantly improved results are obtained by using polygonal-shaped powder instead of spherical, oblong, or shard-shaped particles, as defined in *Powder Metallurgy Science* by Randall M. German, 1994, Chapter 2 and pages 29 and 30, which are herein incorporated by reference.

The green part shrinks substantially during debinding and sintering (typically between 11% and 30%, depending upon the formula of the feedstock and the debinding and sintering parameters). The shrinkage amount, however, is predictable in all dimensions and, once the optimum feedstock formula and parameters are determined, the process is highly consistent and repeatable. The amount of shrinkage that occurs (which is expressed as a percentage equal to one minus the ratio of the size of the finished part to the size of the green part) is referred to as the "shrink factor" and the amount by which the green part must be "over-sized" in order to produce a sintered part of specified dimensions (which is expressed as a percentage that is approximately equal to the ratio of the size of the finished part to the size of the green part) is referred to as the "form factor."

Once an appropriate tungsten-carbide feedstock is developed, and its shrink factors and form factors are determined, a mold is fabricated. The mold will produce a blank or finished die with a specified O.D. and length. A pin or pins is then fabricated to be suspended in the mold cavity, which will form the pilot hole (for a blank) or the I.D. profile (for a finished die). Both the mold cavity and the pin(s) are over-sized to take into account the shrinkage that will occur during debinding and sintering. The feedstock is then molded around the pin(s). When the pin or pins are removed, the pilot hole or I.D. profile has been formed in the green part, and when that green part has been debound and sintered, the blank or finished die has been produced with near net shape.

Producing tungsten-carbide dies by this method offers many advantages. Eliminating most if not all of the secondary operations to produce the blanks and the finished dies saves time and expense. In addition, the dies themselves have improved characteristics. The metal powders used to make tungsten-carbide MIM feedstocks are in the present invention polygonal powders. This produces substantially higher densities in the metal (in excess of 99%, compared to 85% by PM) without the need for secondary processes. The polygonal powders also produce an improved microstructure of the metal, with more uniform bonding. This results in increased transverse rupture strength, which is a widely-accepted method used to determine load-bearing properties. The polygonal powders also make it easier to cut in the I.D. profiles into the blanks than the shard-shaped powders used in PM. This allows the use of harder grades of tungsten-carbide to make the same die. All of these improvements result in enhanced performance and/or utility of the die. One additional benefit of these dies is that, when the die wears so that it is no longer within required tolerances, it can easily be reamed to a larger I.D. and re-used.

DESCRIPTION OF THE INVENTION

An improved tungsten-carbide die, including finished dies and blanks for dies, can be made according to the present invention using polygonal-shaped tungsten-carbide particles with metal injection molding ("MIM") and has many advantages over the prior art. The MIM process is a known fabrication process as taught in, for example U.S. Pat. No. 4,113,480, the disclosure of which is incorporated herein by reference. The die has a cylindrical shape (although it can also be of other shapes) and is flat on both ends. The die has a hole down its middle, extending from one of the flat ends to the other (although the hole can also extend through only a portion of the length of the die). It also could have no hole, in which case it is a blank for a die. The hole is round (a die with a round hole of uniform diameter all the way through its length is referred to a "straight hole" die). The hole can be of any diameter and can also of more than one diameter (e.g. for an extrusion die). Straight hole dies are used as is, or are used as a starting point to make dies with different internal diameter ("I.D.") profiles by various secondary operations. The dies of the present invention can also have an I.D. profile that is other than round.

The hole in the die can be formed by drilling the green part, but it is preferably formed by suspending a pin or pins in the cavity of the mold, and molding the MIM feedstock around the pin(s). The hole in the die is formed by removing the pin(s) from the molded part prior to the debinding and sintering operations (although the pin(s) can also be removed after debinding and prior to sintering). The outside diameter ("O.D.") profile of the pin(s) is round for a straight hole die. In order to produce a die with an I.D. profile that is other than round, the pin(s) are made with the corresponding non-round O.D. profile.

The MIM feedstock contains, in addition to the binders that serve to carry the metal powders into the mold, 85% by weight tungsten-carbide (WC) and 15% by weight cobalt (although the percentages of each can vary widely and metallic binders other than cobalt (e.g. nickel) can be used, as well). In addition, other alloying metals or compounds can be added to the feedstock as additives (e.g. tantalum, tantalum-carbide, titanium-carbide, niobium-carbide, chromium-carbide, cobalt-nickel, nickel-tantalum, titanium-nitride, and diamond dust), which produce different chemical and physical properties in the resulting cemented carbide. In general, the additive (or mixtures thereof) may be present in an amount in the range of from about 0% to about 7% by weight of the sintered article, with about 1% to about 5% being preferred.

By way of example, a die with finished dimensions of 0.625"×0.625" was made using a binder system having just over 50% by weight wax in the binder system offered by the AQUAMIM Division of Planet Polymer Technologies Ltd. of San Diego, Calif. which may be described in Planet Polymer's two patents. No. 5,977,230, issued Nov. 2, 1999, and No. 6,008,281, issued Dec. 28, 1999). Water debinding was unsuccessful with the tungsten-carbide feedstock used for an 85% WC-15% Co feedstock as the parts developed bubbles and blisters in the debinding process.

After considerable effort, we determined that the binders could be removed by dissolving in a hydrocarbon solvent, preferably mineral spirits. We subsequently determined that the mineral spirits should be maintained at a temperature of 80°–120° F. for best results. We have also found that n-propyl bromide is not only an acceptable solvent, but is presently preferred. In general, any liquid linear hydrocarbon such as an alkane solvent may be used, including hexane, heptane, octane or various mixtures of the alkanes. Depending on the thickness of the part, a sufficient amount of the primary binder such as a wax (minimum 70%, and preferably 80% or more) is removed during the rebinding process. The balance of the binders, such as a high molecular weight polyolefin of more than 5,000 gram molecular weight, which give the part its support prior to and during the sintering process, are removed during sintering.

The shrink factor of a particular feedstock and its corresponding form factor are determined by measuring the sintered part and comparing those measurements to those of the green part. It will vary with each feedstock formulation. We provide our toolmaker with the dimensions of the finished part and the form factor for the feedstock that we intend to use. Any toolmaker with reasonable knowledge and skills in the art of making molds could design and fabricate a mold that will produce a green part of the required size. The means to suspend a pin in the mold cavity, and the fabrication of that pin, are also within the toolmaker's purview. One important part of our invention, however, is the concept of using such a suspended pin (or multiple pins) to form the I.D. profile. Not only does this eliminate the secondary operations to cut in the I.D. profile, but it allows the mold that produces a die blank with certain O.D. dimensions to be used to produce an unlimited number of dies (both finished and semi-finished) with different I.D. profiles.

The tungsten-carbide feedstock with polygonal-shaped particles is molded in a conventional injection molding machine. The only modification is that the barrel and screw of the molding machine is made of harder metal than those used in molding plastics. In the barrel, which is heated, the feedstock softens to a toothpaste-like consistency. The optimum temperature of the feedstock will depend upon the formulation of the binders. In the present case, we maintain the barrel temperature within a range from 350° to 400° F. The polygonal-shaped particle feedstock is injected into the mold cavity, and a packing pressure is applied by the molding machine while the feedstock cools and the binders "set up". Sufficiently high molding and packing pressures should be applied in order to achieve the greatest density in the green part, such as for instance 2000–2400 psi. The amount of the holding time depends upon the feedstock formulation, the molding temperature and the size of the part. In the present case, our hold time is 60 seconds. A person of ordinary skill in the operation of an injection molding machine can arrive at the appropriate combination of molding parameters (temperature, shot size, injection speed, injection pressure, packing pressure, hold time, etc.) to produce good molded "green" parts, which is also a function of the molding machine itself.

After the molded part has cooled, we remove as much of the vestiges of the gate and runner system with a saw (in a production mold, most of that vestige will be removed by the mold itself). After a sufficient number of parts have been molded and de-gated, the debinding process is commenced. The green parts are placed in the debinding tank. After the requisite amount of primary binders (as determined by the binder supplier) have been removed producing the brown preform or part (we determine that by drying and weighing the parts from time to time), the parts are placed in a high temperature sintering furnace. An appropriate sintering profile is developed, depending on the size of the part, the quantity and nature of the secondary binders and the characteristics of the metal powders all as is well known in the powder metallurgy art. Typically, the temperature is initially increased gradually so that the secondary binders can melt and/or evaporate without deforming the part. The temperature is then ramped up more rapidly to a higher temperature level, held at that level for a certain period of time, and then ramped up to a higher level, held again, etc., until the part reaches the optimum sintering temperature. The temperature is held at that level for a certain period of time. During that process, the metal powders fuse together forming a coherent, densified matrix. The temperature in the furnace is then brought down, typically in stages, as in the ramp-up phase. The temperatures, ramp rates and hold times of a complete sintering cycle are referred to as the sintering profile. A person of ordinary skill in the art of sintering tungsten-carbide can devise an appropriate profile, which is also a function of the furnace itself. Table 1 is a current profile used to sinter the 0.625"×0.625 die with the current formulation of our feedstock.

TABLE 1

| Segment # (1 to 100) | 1 | 2 | 3 | 4 | 5 | 6 | 7 | 8 | 9 | 10 |
|---|---|---|---|---|---|---|---|---|---|---|
| Segment Type (ramp/soak) | ramp | soak | ramp | soak | ramp | soak | ramp | ramp | soak | soak |
| Target Setpoint (0–1650) | 275 | 275 | 475 | 475 | 1050 | 1050 | 1350 | 1370 | 1370 | 75 |
| Ramp in Deg C./Min (Soak in Min) | 3 | 60 | 3 | 90 | 3 | 60 | 5 | 2 | 60 | 5 |
| Guaranteed Flag (Y/N) | n | n | n | n | n | n | n | n | n | y |
| Positive Deviation (0–1650) | 0 | 0 | 0 | 0 | 0 | 0 | 0 | 0 | 0 | 0 |
| Negative Deviation (0–1650) | 0 | 0 | 0 | 0 | 0 | 0 | 0 | 0 | 0 | 75 |
| PID #1 = Ramp, 2-Soak (1–2) | 1 | 2 | 1 | 2 | 1 | 2 | 1 | 1 | 1 | 2 |
| Debind Cycle (Y/N) | y | y | y | y | n | n | n | n | n | n |
| Heaters On (Y/N) | y | y | y | y | y | y | y | y | y | n |
| Sinter Cycle (Y/N) | n | n | n | n | y | y | y | y | y | n |
| Partial Pressure Setpoint (0–760) | 300 | 300 | 300 | 300 | 300 | 300 | 300 | 300 | 300 | 700 |
| H2 Hot Zone Setpoint* (0–35) | 2 | 2 | 2 | 2 | 2 | 2 | 2 | 2 | 2 | 0 |
| H2 Retort Setpoint* (0–35) | 12 | 12 | 12 | 12 | 6 | 6 | 6 | 6 | 8 | 0 |
| Process Gas* (Off. N2/Ar/Air/bub) | off | off | off | off | off | off | off | off | off | Ar |
| Proc. Gas Hot Zone Setpoint (0–35) | 0 | 0 | 0 | 0 | 0 | 0 | 0 | 0 | 0 | 30 |
| Proc. Gas Retort Setpoint (0–35) | 0 | 0 | 0 | 0 | 0 | 0 | 0 | 0 | 0 | 30 |
| High Vacuum Cycle (Y/N) | n | n | n | n | n | n | n | n | n | n |
| High Vacuum Hold (Y/N) | n | n | n | n | n | n | n | n | n | n |
| Cool Down Event (Y/N) | n | n | n | n | n | n | n | n | n | y |
| Cool Down Pressure (0–760) | 0 | 0 | 0 | 0 | 0 | 0 | 0 | 0 | 0 | 760 |
| Cool Down Temperature (0–1000) | 0 | 0 | 0 | 0 | 0 | 0 | 0 | 0 | 0 | 1000 |
| N2 Quench (Y/N) | n | n | n | n | n | n | n | n | n | n |
| Retort Shutters (Y/N) | n | n | n | n | n | n | n | n | n | y |
| Profile Name | Ryerwcl | | | | | | | | | |
| Configured Date | 1/26/01 | | | | | | | | | |
| Developer | BCS | | | | | | | | | |

*Warning: During an air or bubbler event DO NOT set the furnace temperature greater than 320° C. After an Air or Bubbler or before a Hydrogen Event insert a segment to evacuate the chamber The inventive process is very consistent and highly repeatable. While the following is typical but not as good as the best results achieved, our most recent dies (which are made of 85% by volume tungsten-carbide and 15% by volume cobalt) consistently exhibit the following characteristics, based upon tests by an independent testing laboratory [the numbers in the brackets are the corresponding figures for a PM sample, which turned out to be 84% WC-16% Co]:

1. Density (as a percentage of theoretical), based on ASTM B-276-91: 99.3%. We have densities as high as 99.7% [88%];
2. Microhardness: 86–87 Ra [85–86 Ra],
3. Transverse Rupture Strength (TRS), based on ASTM B-406-96: 275,000–325,000 psi [350,000–425,000 psi].

According to an independent testing service, the lower TRS for our dies is not necessarily a bad thing, especially for an impact application. The microstructure of the metal of our dies, because of the polygonal powders and higher densities, will likely make that metal tougher than the PM die, and more resistant to cracking. This latter condition also dictates the approximate atmosphere within the furnace chamber. Our dies have greater reamability than comparable PM dies. Our tungsten-carbide dies with 15 weight percent cobalt can be reamed with standard reaming tools used for tungsten-carbide die, but PM dies must have at least 20 weight percent cobalt to be reamed with standard tools.

In our process, we use polygonal metal powders. Typically, but not necessarily, that means a mean particle size of less than 15 μm, preferably 2 to 6 μm. However, submicron particles to particles having a mean particle size of 0.1 microns have been used. Mean particle diameters of up to about 30 microns have been used with the preferred range being between about 1.5 to about 5 microns. We vary the composition and the particle sizes of our feedstocks, depending on the application to which the die will be put. Some applications (such as header dies) produce better results with dies made from smaller particles. We also vary the distribution of particle sizes around the mean.

The dies made in accordance with the present invention have many applications, in many different industries. We have initially targeted applications in the fastener industry. In that industry, the inventive dies can be used in so-called "cold heading" machines, and would be referred to as "header dies", but we can also use the inventive dies in so-called "hot heading". Header dies are typically used in the fastener industry to form the body of a screw, nail, rivet or other fastener. There are many other "tools" used in the fastener industry that are currently made from tungsten-carbide, and still others that would be better if made from tungsten-carbide. These other types of tools include punches, upsets, hammers, fingers, transfer fingers, quills, cutters, trim dies, draw dies, saws, pinch point dies, forging dies and roll thread dies. Our dies can also be used in stamping applications. The method of our invention can be used to make all of these tools out of tungsten-carbide with or without an additive, as previously disclosed, using our injection molding process. As in the case of our dies, the metallurgical properties of the injection molded metals will result in improved tools.

We have varied the cobalt concentration from about 3 to about 35 percent by weight. At 6% by weight cobalt we have achieved greater than 99% of theoretical density without hipping. At 3% by volume cobalt, we have achieved abut 85% of theoretical density without hipping. Tools have been made using both 15% and 25% by weight cobalt as a percentage of the final article.

Moreover, we have made header dies (cylinders with a central aperture) with both inner and outer diameters with little shrinkage and superior densities.

While there has been disclosed what is considered to be the preferred embodiment of the present invention it is understood that various changes in the details may be made without departing from the spirit or sacrificing any of the advantages of the present invention.

We claim:

1. A process of making an article comprised of a tungsten-carbide-cobalt alloy with or without an additive of one or more of tantalum, cobalt-nickel, nickel-tantalum, tantalum-carbide, titanium-carbide, niobium-carbide, chromium-carbide, titanium-nitride and diamond dust, comprising the steps of forming a homogeneous mixture of polygonal-shaped powder tungsten-carbide-cobalt and a polygonal-shaped powder additive and a binder including wax and a high molecular weight polyolefin polymer wherein the additive is present in the range of from about 0% to about 7% by weight of the article, injecting the mixture under heat and pressure into a metal injection mold to form a green preform of the article;

immersing the green preform in one or more of mineral spirits or n-propyl bromide or a liquid alkane, to dissolve and remove the wax and convert the green preform into a brown preform of the article; and sintering the brown preform to remove the remainder of the binder and to densify the brown preform into an article comprised of tungsten-carbide-cobalt with or without an additive, the article having a density not less than 98% of theoretical when cobalt is present in an amount not less than about 3% by weight of the article.

2. The process of claim 1, wherein the polygonal powders have mean particle diameters in the range of from about 1.5 to about 5 microns.

3. The process of claim 1, wherein the binder is present in the green preform in the range of from about 3 to about 10 weight percent.

4. The process of claim 1, wherein the binder is at least 50% wax.

5. The process of claim 1, wherein the green perform is immersed in mineral spirits.

6. The process of claim 1, wherein the green perform is immersed in n-propyl bromide.

7. The process of claim 1, wherein the green perform is immersed in liquid alkane.

8. The process of claim 7, wherein the liquid alkane is hexane, heptane, octane or mixtures including any one thereof.

9. The process of claim 1, wherein the high molecular weight polyolefin has a gram molecular weight not less than about 5000.

10. The process of claim 1, wherein the additive is present in the range of from about 1% to about 5% by weight of the article.

11. The process of claim 1, wherein the sintered article has a density not less than 99% of theoretical.

12. The process of claim 1, wherein the cobalt is present in the range of from about 6% to about 35% by weight of the article.

13. The process of claim 12, wherein the cobalt is present in the range of from about 15% to about 25% by weight of the article.

14. An article made according to the process of claim 1, wherein substantially all the particles of the homogeneous powder are polygonal shaped.

15. An article made according to the process of claim 12, wherein substantially all the particles of the homogeneous powder are polygonal shaped.

16. An article of a tungsten-carbide-cobalt alloy with or without an additive of one or more of tantalum, cobalt-nickel, nickel-tantalum, tantalum-carbide, titanium-carbide, niobium-carbide, chromium carbide, titanium-nitride and diamond dust, made by the process of forming a homogeneous mixture of polygonal-shaped powder tungsten-carbide-cobalt and a polygonal-shaped powder additive and a binder including a wax and a high molecular weight polyolefin polymer wherein the additive is present in the range of from about 0% to about 7% by weight of the article;

injecting the mixture under heat and pressure into a metal injection mold to form a green preform of the article; and immersing the green preform in a linear hydrocarbon or a halogenated hydrocarbon or mixtures thereof to dissolve and remove the wax and convert the green preform into a brown preform of the article.

17. The article of claim 16, wherein the article is in the form of a torx pin.

18. The article of claim 16, wherein the article is in the form of a header die.

19. The article of claim 16, wherein the article is in the form of a fastener industry tool.

20. The article of claim 19, wherein the article is in the form of one or more of a punch, an upset, a hammer, a finger, a transfer finger, a quill, a cutter, a train die, a draw die, a saw, a pinch pont die, a forging die and a roll thread die.

21. The article of claim 20, wherein the cobalt is present in an amount about 15% by weight.

22. The article of claim 21, wherein the cobalt is present in an amount of about 25% by weight.

23. A process of making an article comprised of a tungsten-carbide-cobalt alloy with or without an additive of one or more of tantalum, cobalt-nickel, nickel-tantalum, tantalum-carbide, titanium-carbide, niobium-carbide, chromium-carbide, titanium-nitride and diamond dust, comprising the steps of forming a homogeneous mixture of polygonal-shaped powder tungsten-carbide-cobalt and a polygonal-shaped powder additive and a binder including wax and a high molecular weight polyolefin polymer wherein the additive is present in the range of from about 0% to about 7% by weight of the article, substantially all of said powders being polygonal shaped and having mean particle diameters in the range of from about 0.1 to about 30 microns;

injecting the mixture under heat and pressure into a metal injection mold to form a green preform of the article;

immersing the green preform in a linear hydrocarbon or a halogenated hydrocarbon or mixtures thereof to dissolve and remove the wax and convert the green preform into a brown preform of the article; and sintering the brown preform to remove the remainder of the binder and to densify the brown preform into an article comprised of tungsten-carbide-cobalt with or without an additive, the article having a density not less than 98% of theoretical when cobalt is present in an amount not less than about 3% by weight of the article.

24. An article of a tungsten-carbide-cobalt alloy with or without an additive of one or more of tantalum, cobalt-nickel, nickel-tantalum, tantalum-carbide, titanium-carbide, niobium-carbide, chromium carbide, titanium-nitride and diamond dust, made by the process of forming a homogeneous mixture of polygonal-shaped powder tungsten-carbide-cobalt and a polygonal-shaped powder additive and a binder including a wax and a high molecular weight polyolefin polymer wherein the additive is present up to about 7% by weight of the article;

injecting the mixture under heat and pressure into a metal injection mold to form a green preform of the article; and immersing the green preform in a linear hydrocarbon or a halogenated hydrocarbon or mixtures thereof to dissolve and remove the wax and convert the green preform into a brown preform of the article.

25. An article of a tungsten-carbide-cobalt alloy with or without an additive of one or more of tantalum, cobalt-nickel, nickel-tantalum, tantalum-carbide, titanium-carbide, niobium-carbide, chromium carbide, titanium-nitride and diamond dust, made by the process of forming a homogeneous mixture of polygonal-shaped powder tungsten-carbide-cobalt and a polygonal-shaped powder additive and a binder including a wax and a high molecular weight polyolefin polymer wherein the additive is present in the range of from about 0% to about 7% by weight of the article;

injecting the mixture under heat and pressure into a metal injection mold to form a green preform of the article; and immersing the green preform in a linear hydrocarbon or a halogenated hydrocarbon or mixtures thereof to dissolve and remove the wax and convert the green preform into a brown preform of the article.

* * * * *

UNITED STATES PATENT AND TRADEMARK OFFICE

CERTIFICATE OF CORRECTION

PATENT NO. : 6,790,252 B2
DATED : September 14, 2004
INVENTOR(S) : David J. Smith et al.

It is certified that error appears in the above-identified patent and that said Letters Patent is hereby corrected as shown below:

Column 8,
Lines 13, 15 and 17, “perform” should be -- preform --.

Column 9,
Line 2, “dic” should be -- die --.

Signed and Sealed this

Fifth Day of April, 2005

JON W. DUDAS
*Director of the United States Patent and Trademark Office*